US012704273B2

(12) United States Patent
Yu et al.

(10) Patent No.: US 12,704,273 B2
(45) Date of Patent: Aug. 11, 2026

(54) AIR CONDITIONER OUTDOOR UNIT AND AIR CONDITIONER

(71) Applicants: HEFEI MIDEA HEATING & VENTILATING EQUIPMENT CO., LTD., Hefei (CN); GD MIDEA HEATING & VENTILATING EQUIPMENT CO., LTD., Foshan (CN)

(72) Inventors: Dongdong Yu, Foshan (CN); Yuefei Li, Foshan (CN); Dongpo Li, Foshan (CN)

(73) Assignees: HEFEI MIDEA HEATING & VENTILATING EQUIPMENT CO., LTD., Hefei (CN); GD MIDEA HEATING & VENTILATING EQUIPMENT CO., LTD., Foshan (CN)

( * ) Notice: Subject to any disclaimer, the term of this patent is extended or adjusted under 35 U.S.C. 154(b) by 96 days.

(21) Appl. No.: 18/895,678

(22) Filed: Sep. 25, 2024

(65) Prior Publication Data

US 2025/0102159 A1 Mar. 27, 2025

(30) Foreign Application Priority Data

Sep. 25, 2023 (CN) ..... 202311250814.6

(51) Int. Cl.
*F24F 1/38* (2011.01)
*F24F 1/12* (2011.01)
(Continued)

(52) U.S. Cl.
CPC ..... *F24F 1/38* (2013.01); *F24F 1/12* (2013.01); *F24F 1/16* (2013.01); *F24F 1/56* (2013.01)

(58) Field of Classification Search
CPC ..... F24F 1/38; F24F 1/12; F24F 1/56; F24F 1/40; F04D 29/384
See application file for complete search history.

(56) References Cited

U.S. PATENT DOCUMENTS

2020/0088421 A1* 3/2020 Jang ..... F24F 1/50

FOREIGN PATENT DOCUMENTS

CN 201679745 U 12/2010
CN 105026768 A 11/2015
(Continued)

OTHER PUBLICATIONS

First office Action dated Mar. 9, 2026 received in Chinese Patent Application No. 202311250814.6.

*Primary Examiner* — Frantz F Jules
*Assistant Examiner* — Cassey D Bauer
(74) *Attorney, Agent, or Firm* — Scully, Scott, Murphy & Presser, P.C.

(57) ABSTRACT

An air conditioner outdoor unit and an air conditioner are provided. The air conditioner outdoor unit includes: a cabinet, which is provided with an air inlet and an air outlet; a refrigerant circulation device, which is arranged inside the cabinet, and partial region of which interferes with an airflow path between the air inlet and the air outlet; and a fan, which is provided inside the cabinet and arranged opposite to the air outlet. In a direction of a rotational axis of the fan, the partial region has a projection region on the fan. The fan is provided with at least one fan blade. An installation angle of the fan blade at any elementary stage within the projection region is larger than an installation angle of the fan blade at an elementary stage outside the projection region.

10 Claims, 7 Drawing Sheets

(51) Int. Cl.
*F24F 1/16* (2011.01)
*F24F 1/56* (2011.01)

(56) References Cited

FOREIGN PATENT DOCUMENTS

| | | | |
|---|---|---|---|
| CN | 106438470 | A | 2/2017 |
| CN | 115704579 | A | 2/2023 |
| CN | 115885112 | A | 3/2023 |

* cited by examiner

B - B

AIR CONDITIONER OUTDOOR UNIT AND AIR CONDITIONER

CROSS-REFERENCE TO RELATED APPLICATION

This application claims priority under 35 U.S.C. § 119 to Chinese Patent Application No. 202311250814.6 filed on Sep. 25, 2023, the entire contents of which are incorporated herein by reference for all purposes.

TECHNICAL FIELD

The present disclosure relates to the technical field of air conditioning, and particularly, relates to an air conditioner outdoor unit and an air conditioner.

BACKGROUND

This section only provides background information related to the present disclosure, which is not necessarily the prior art.

For an outdoor unit of HVAC (Heating, Ventilation and Air Conditioning) apparatus, various power elements are usually provided inside the outdoor unit. When the power elements are located on a flow path of airflow of the outdoor unit, they will affect the working efficiency of a fan of the outdoor unit, which is manifested by uneven work done by fan blades of the fan. Thus, the working capacity of the fan is affected and aerodynamic noise can even be increased.

SUMMARY

An object of the present disclosure is to at least solve the technical problem of how to improve the working capacity of the fan of the air conditioner outdoor unit, and this object is achieved through the following technical solutions.

The present disclosure provides an air conditioner outdoor unit, which includes:

- a cabinet, which is provided with an air inlet and an air outlet, an airflow path being formed between the air inlet and the air outlet;
- a refrigerant circulation device, which is arranged inside the cabinet and has a component part located on the airflow path; and
- a fan, which is provided inside the cabinet and arranged opposite to the air outlet; in which in a direction of a rotational axis of the fan, the component part has a projection region on the fan, and the fan is provided with at least one fan blade; an installation angle of the fan blade at an elementary stage within the projection region is a first installation angle, an installation angle of the fan blade at an elementary stage outside the projection region is a second installation angle, and any of the first installation angles is larger than the second installation angle.

In the air conditioner outdoor unit of the present disclosure, the fan is improved to reduce the influence of the refrigerant circulation device inside the cabinet on the work done by the fan. By using the refrigerant circulation device that interferes with the airflow path inside the cabinet, the installation angle in the projection region on the fan is improved. The installation angle of the fan blade of the fan at any elementary stage within the projection region is larger than the installation angle at the elementary stage outside the projection region, making the work done by the fan blades of the fan more uniform and improving the working capacity of the fan.

In addition, the air conditioner outdoor unit according to the present disclosure may also have the following additional technical features.

In some embodiments of the present disclosure, a first circular region with a point on the rotational axis as the center is provided in a plane perpendicular to the rotational axis;

- the area of the first circular region is larger than or equal to the projection region, the projection region is located within the first circular region, and there is at least one intersection point between an outer edge of the first circular region and an outer edge of the projection region; and
- an installation angle of the fan blade at the elementary stage within the first circular region is a third installation angle, an installation angle of the fan blade at the elementary stage outside the first circular region is a fourth installation angle, and any of the third installation angles is larger than the fourth installation angle.

In some embodiments of the present disclosure, the refrigerant circulation device includes a compressor and a liquid storage tank connected to the compressor, and the compressor and the liquid storage tank are located on one side of the fan in the direction of the rotational axis.

In some embodiments of the present disclosure, the fan has at least one fan blade, which has a rear edge of the fan blade and an outer edge of the fan blade; the outer edge of the fan blade is a side of the fan blade that is away from the rotational axis of the fan, and the rear edge of the fan blade is connected to the outer edge of the fan blade; the orientation of the rear edge of the fan blade is opposite to the rotational direction of the fan, and a vortex disturbing structure is provided on the rear edge of the fan blade.

In some embodiments of the present disclosure, the air conditioner outdoor unit further includes a flow guide member, which is sleeved on an outer side of the fan; the flow guide member includes an inlet section, an outlet section, and a middle section; the middle section is connected between the inlet section and the outlet section, and at least a part of the vortex disturbing structure is provided in the middle section.

In some embodiments of the present disclosure, the flow guide member is provided with a noise reduction structure, which is formed in the outlet section and/or the inlet section.

In some embodiments of the present disclosure, the refrigerant circulation device further includes a heat exchanger, which is arranged inside the cabinet and located on a side of the fan that is away from the air outlet.

In some embodiments of the present disclosure, the heat exchanger is arranged to extend in a circumferential direction of a side wall of the cabinet and enclose a heat exchange channel.

In some embodiments of the present disclosure, the air outlet is arranged at an upper end of the cabinet, the air inlet is arranged on the side wall of the cabinet, and both the air inlet and the air outlet are communicated with the heat exchange channel.

A second aspect of the present disclosure also provides an air conditioner, which includes the air conditioner outdoor unit as described in any one of the above items.

BRIEF DESCRIPTION OF THE DRAWINGS

Upon reading the detailed description of the preferred embodiments below, various other advantages and benefits will become clear to those skilled in the art. The accompanying drawings are only used for the purpose of illustrating preferred embodiments, and should not be considered as a limitation to the present disclosure. Moreover, throughout the drawings, the same reference signs are used to denote the same components. In the drawings.

LIST OF REFERENCE SIGNS

Figure 1:
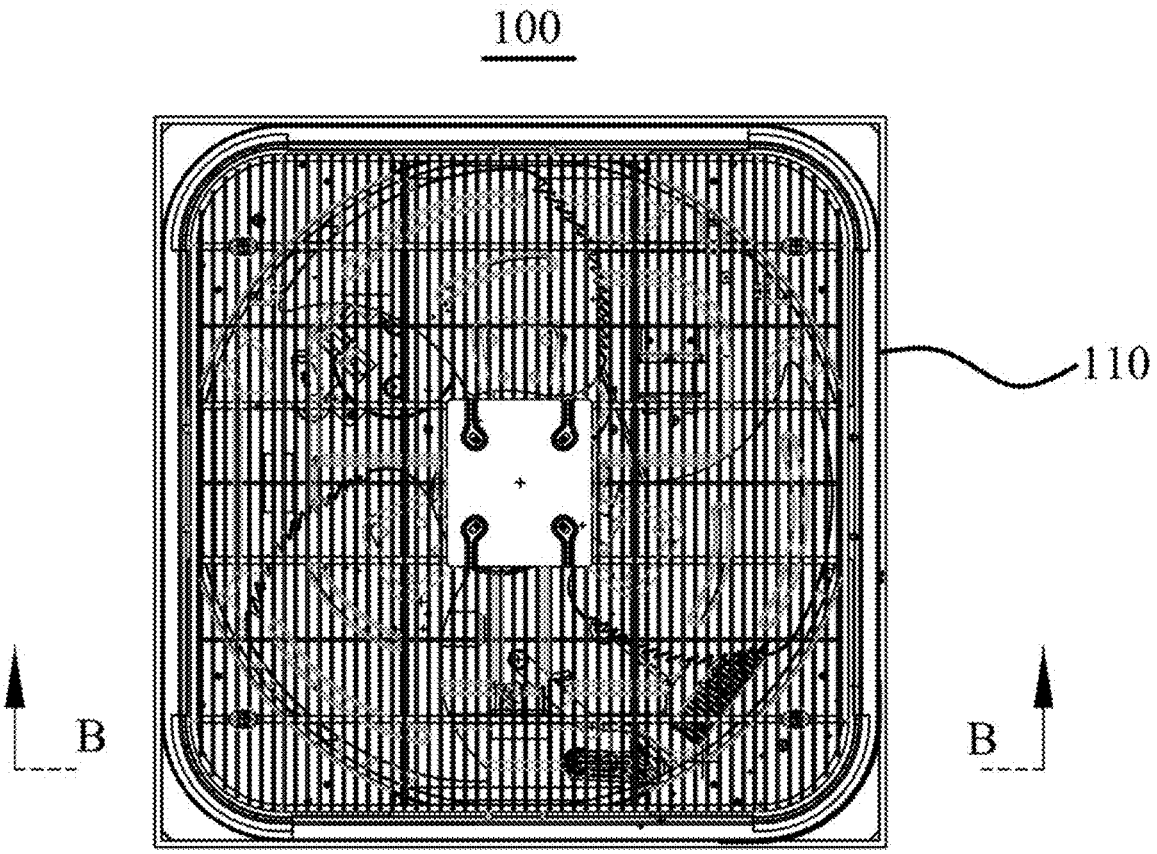
FIG. 1 is a schematic structural view of the air conditioner outdoor unit according to an embodiment of the present disclosure.
Figure 2:
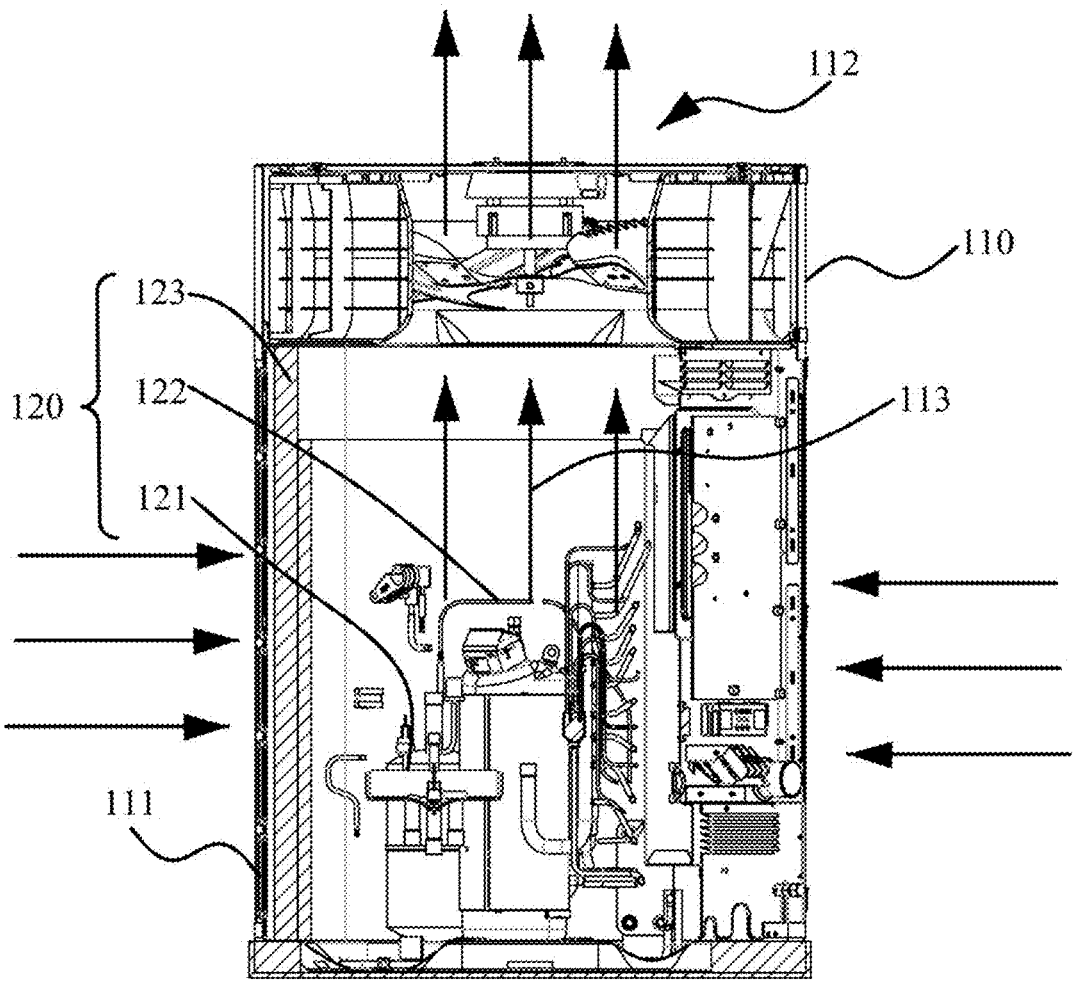
FIG. 2 is a cross-sectional view taken along line B-B in FIG. 1.
Figure 3:
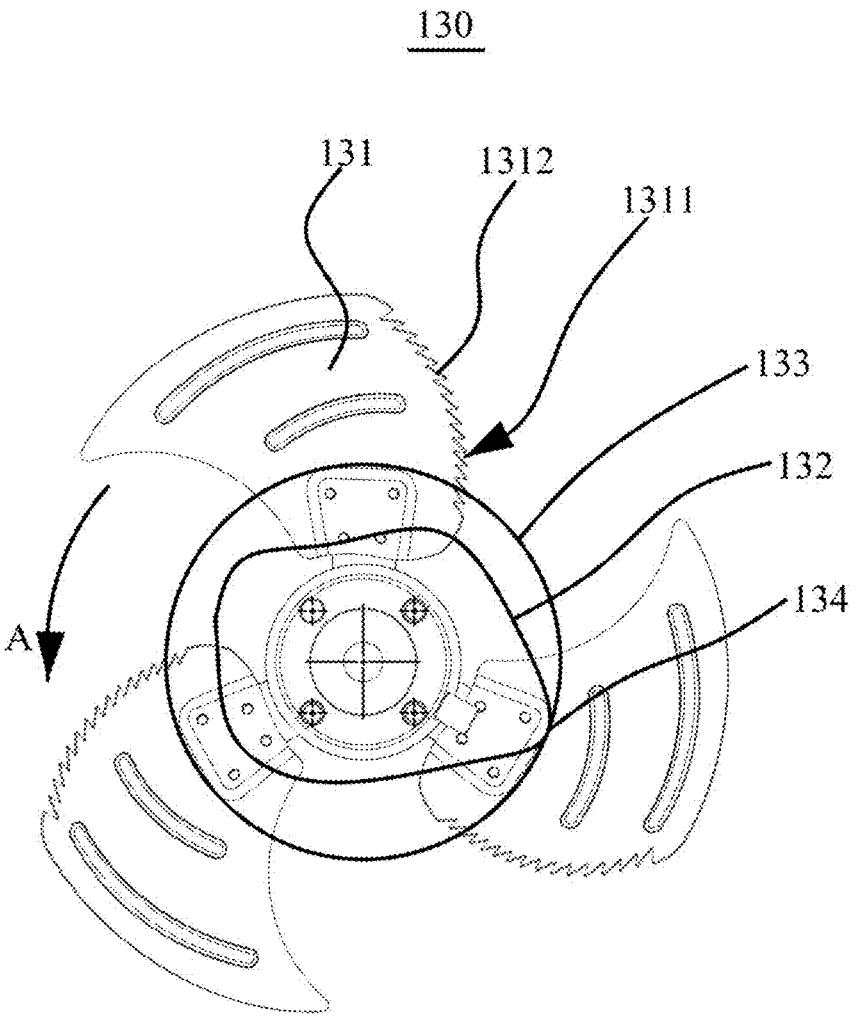
FIG. 3 is a schematic structural view of a fan of the air conditioner outdoor unit according to an embodiment of the present disclosure, showing a projection region and a first circular region.

100: air conditioner outdoor unit;

110: cabinet; 111: air inlet; 112: air outlet; 113: airflow path;

120: refrigerant circulation device; 121: compressor; 122: liquid storage tank; 123: heat exchanger;

130: fan; 131: fan blade; 1311: rear edge of fan blade; 1312: vortex disturbing structure; 132: projection region; 133: first circular region; 134: inscribed point; a: installation angle at elementary stage;

A: rotational direction of fan;

140: flow guide member; 141: inlet section; 142: outlet section; 143: middle section; 144: flow guide channel; 145: noise reduction structure.

DETAILED DESCRIPTION

Hereinafter, exemplary embodiments of the present disclosure will be described in greater detail with reference to the accompanying drawings. Although the exemplary embodiments of the present disclosure are shown in the drawings, it should be understood that the present disclosure may be implemented in various forms and should not be limited by the embodiments set forth herein. On the contrary, these embodiments are provided to enable a more thorough understanding of the present disclosure and to fully convey the scope of the present disclosure to those skilled in the art.

It should be understood that the terms used herein are only for the purpose of describing specific exemplary embodiments, and are not intended to be limitative. Unless clearly indicated otherwise in the context, singular forms "a", "an", and "said" as used herein may also mean that plural forms are included. Terms "include", "comprise", "contain" and "have" are inclusive, and therefore indicate the existence of the stated features, steps, operations, elements and/or components, but do not exclude the existence or addition of one or more other features, steps, operations, elements, components, and/or combinations thereof. The method steps, processes, and operations described herein should not be interpreted as requiring them to be executed in the specific order described or illustrated, unless the order of execution is clearly indicated. It should also be understood that additional or alternative steps may be used.

Although terms "first", "second", "third" and the like may be used herein to describe multiple elements, components, regions, layers and/or sections, these elements, components, regions, layers and/or sections should not be limited by these terms. These terms may only be used to distinguish one element, component, region, layer or section from another region, layer or section. Unless clearly indicated in the context, terms such as "first", "second" and other numerical terms do not imply an order or sequence when they are used herein. Therefore, the first element, component, region, layer or section discussed below may be referred to as a second element, component, region, layer or section without departing from the teachings of the exemplary embodiments.

For ease of description, spatial relative terms may be used herein to describe the relationship of one element or feature relative to another element or feature as shown in the drawings. These relative terms are, for example, "inner", "outer", "inside", "outside", "below", "under", "above", "over", etc. These spatial relative terms are intended to include different orientations of the device in use or in operation in addition to the orientation depicted in the drawings. For example, if the device in the FIG. is turned over, then elements described as "below other elements or features" or "under other elements or features" will be oriented "above the other elements or features" or "over the other elements or features". Thus, the exemplary term "below" may include orientations of both above and below. The device can be otherwise oriented (rotated by 90 degrees or in other directions), and the spatial relationship descriptors used herein will be explained accordingly.

An aspect of the present disclosure provides an air conditioner outdoor unit 100, which includes a cabinet 110 and a fan 130. The cabinet 110 is provided with an air inlet 111 and an air outlet 112, and an airflow path 113 is formed between the air inlet 111 and the air outlet 112 of the cabinet 110. The fan 130 is provided inside the cabinet 110. Under the action of the fan 130, the air outside the cabinet 110 enters from the air inlet 111, flows along the airflow path 113 to the air outlet 112, and is discharged to the outside of the cabinet 110.

Due to the need of the air conditioner outdoor unit 100, different power elements, such as, a compressor 121, an electrical control box, a heat exchanger 123 and the like are arranged inside the cabinet 110. When these power elements interfere with the airflow path 113, they will affect the working efficiency of the fan 130.

In particular, when the air outlet 112 of the air conditioner outdoor unit 100 is arranged at the top of the cabinet 110 and the air inlet 111 is arranged at the side of the cabinet 110, the power elements inside the cabinet 110 may readily affect the working efficiency and working capacity of fan blades 131 on the fan 130.

In order to reduce the influence on the fan 130 mentioned above, the fan 130 is further improved in the air conditioner outdoor unit 100 of the present disclosure. At least one fan blade 131 is provided on the fan 130. By adjusting an installation angle of the fan blade 131, the work done by different regions of the fan blade 131 is more uniform, and there will be no stagnant region of airflow in an upper part of the fan 130. In a direction of the rotational axis of the fan 130, partial region of a refrigerant circulation device 120 has a projection region 132 on the fan 130. An installation angle α of the fan blade 131 of the fan 130 at an elementary stage within the projection region 132 is different from an installation angle α of the fan blade 131 of the fan 130 at an elementary stage outside the projection region 132.

In order to reduce the influence of partial region of power elements on the working capacity of the fan blade 131, the installation angle α of the fan blade 131 at the elementary stage within the projection region 132 is made larger than the installation angle α of the fan blade 131 at the elementary stage outside the projection region 132. When any installation angle of the fan blade 131 at the elementary stage within the projection region 132 is larger than the installation angle α of the fan blade 131 at the elementary stage outside the projection region 132, the influence of power elements on the working of the fan 130 can be significantly reduced, and the stagnation region of airflow in partial region near the fan 130 can be eliminated. The working capacity of the fan blade 131 of the fan 130 is increased, and the working efficiency of the fan blade 131 of the fan 130 is improved.

Figure 4:
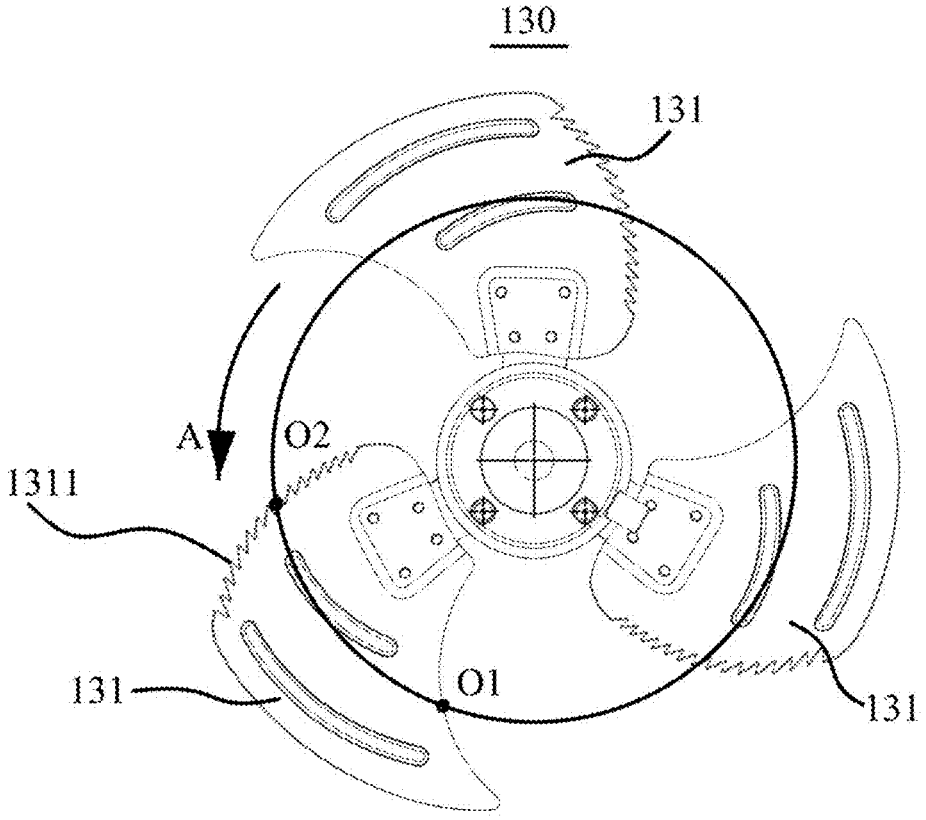
FIG. 4 is a schematic structural view of the fan of the air conditioner outdoor unit according to an embodiment of the present disclosure, showing intersection points between a base circle of the fan and front and rear edges of a fan blade.
Figure 5:
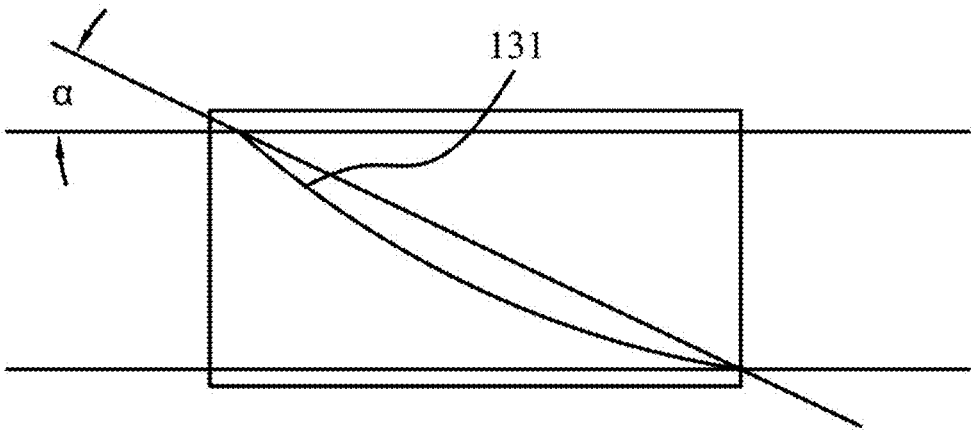
FIG. 5 schematically shows an installation angle of the fan of the air conditioner outdoor unit according to an embodiment of the present disclosure.
Figure 6:
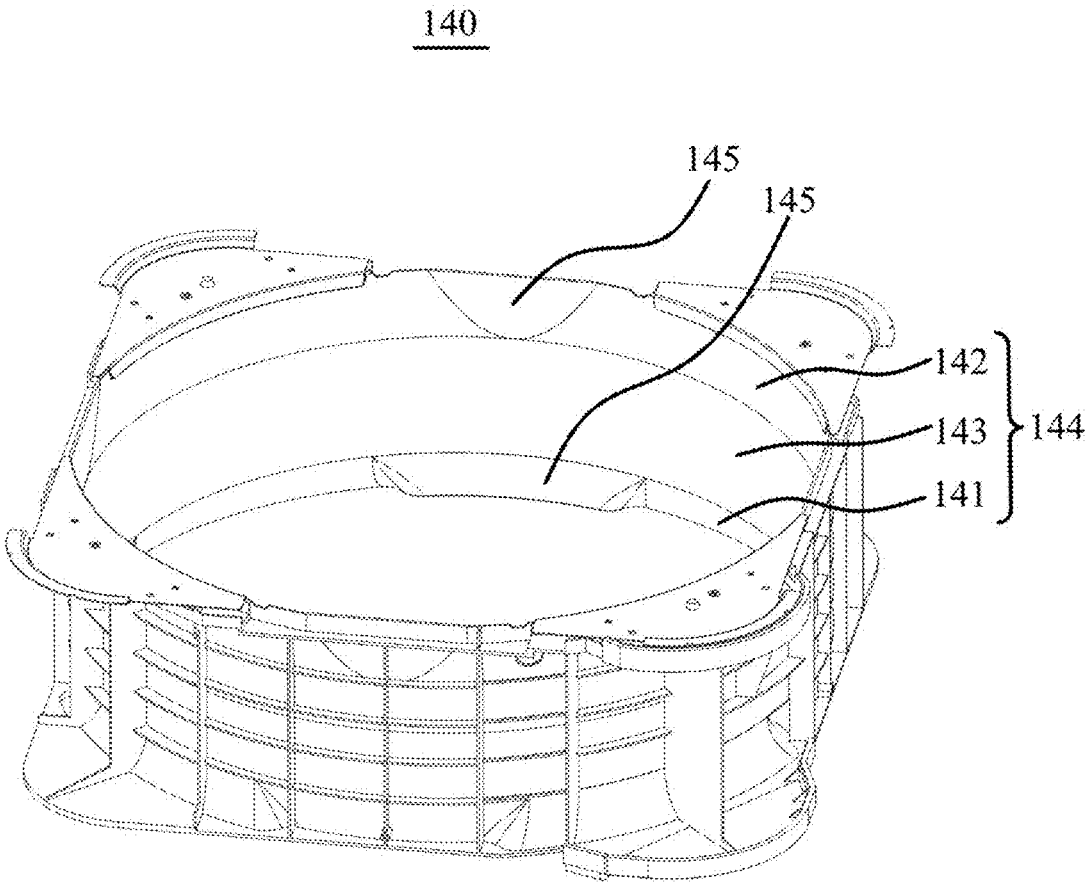
FIG. 6 is a schematic structural view of a flow guide member of the air conditioner outdoor unit according to an embodiment of the present disclosure.
Figure 7:
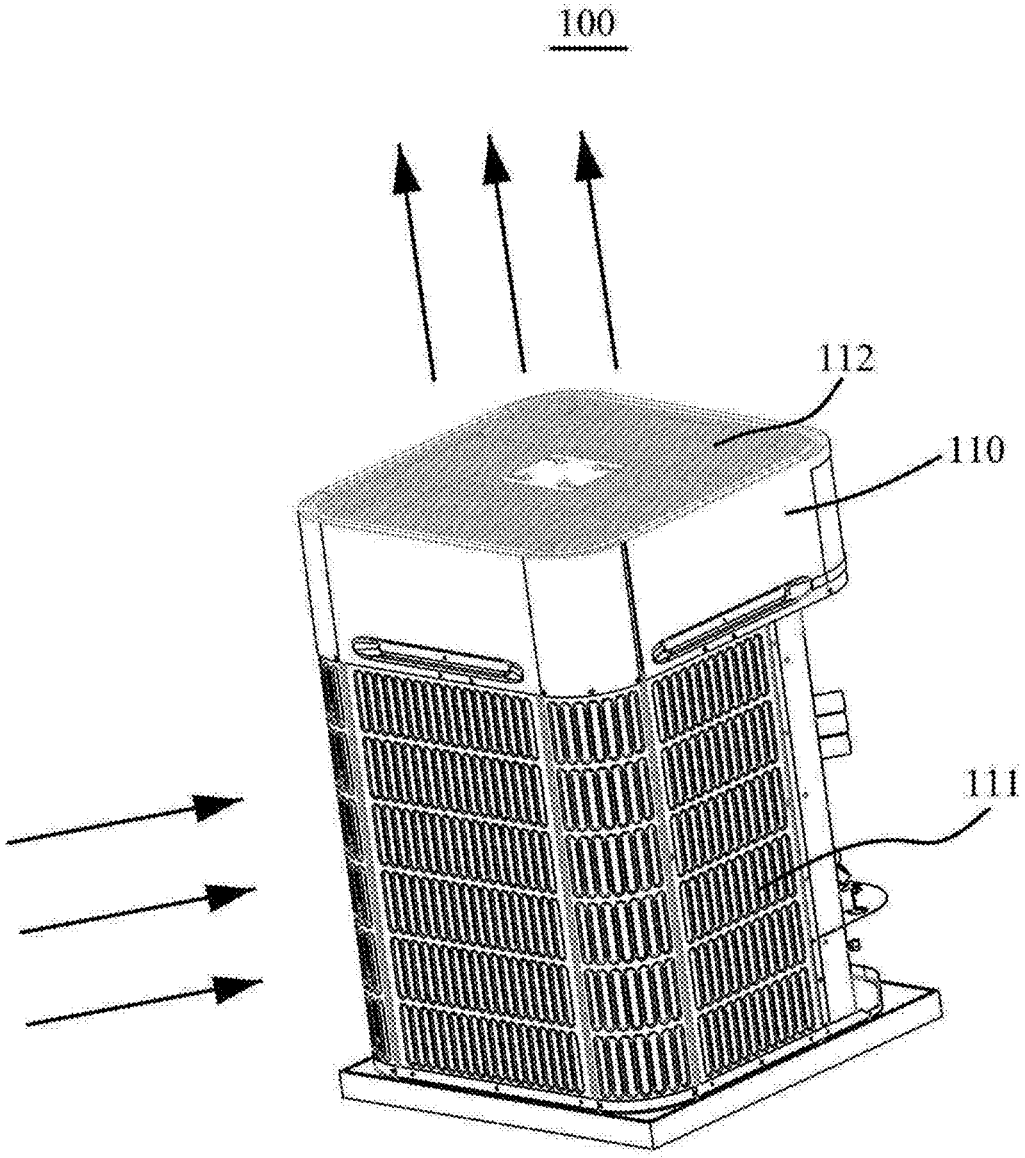
FIG. 7 is a schematic structural view of the air conditioner outdoor unit according to an embodiment of the present disclosure.

It should be noted that the installation angle α at the elementary stage of the fan 130 of the air conditioner outdoor unit 100 of the present disclosure is explained as follows. As shown in FIGS. 4 and 5, in the rotational direction A of the fan 130, as the fan blade 131 of the fan 130 rotates, a point O1 on a front edge of the fan blade 131 of the fan 130 will correspond to a point O2 on a rear edge 1311 of the fan blade of the fan 130, the arc between O1 and O2 is stretched to form a straight line O1O2, and the included angle α formed by the plane perpendicular to the rotational axis of the fan 130 and the straight line O1O2 is the elementary stage installation angle involved in the embodiment of the present disclosure.

As shown in FIG. 4, in the plane perpendicular to the rotational axis of the fan 130, a circle is formed with a point on the rotational axis as the center and any distance between the rotational axis and inner and outer edges of the fan blade 131 as the radius. The intersection point between the circle and the front edge of the fan blade 131 is point O1, and the intersection point between the circle and the rear edge 1311 of the fan blade is point O2. The point O1 and the point O2 on the fan blade 131 are connected to obtain a straight line O1O2. As shown in FIG. 5, the included angle between the straight line O1O2 and the plane perpendicular to the rotational axis is a, which is referred to as the elementary stage installation angle α.

In the air conditioner outdoor unit 100 provided in this embodiment, the structure of the fan blade 131 of the fan 130 is improved to overcome the influence of power elements in the cabinet 110 of the air conditioner outdoor unit 100 on the working of the fan. The technical effect achieved by the structural improvement of the fan 130 of the air conditioner outdoor unit 100 of the present disclosure is further explained as follows. The air inlet 111 of the air conditioner outdoor unit 100 is arranged on the cabinet 110, and the airflow path 113 between the air inlet 111 and the air outlet 112 of the air conditioner outdoor unit 100 is disturbed by the refrigerant circulation device 120, which affects the flow of airflow toward the fan blade 131 of the fan 130, resulting in an affected working capacity of the fan blade 131 of the fan 130. By adjusting the installation angle of the fan blade 131 in the disturbed region, the working capacity of the fan blade 131 is made consistent in various regions, thereby improving the overall working capacity of the fan 130, and eliminating the influence of power elements on the working capacity and working efficiency of the fan 130.

When a cover plate or top cover is provided at the air outlet 112 of the cabinet 110, due to the influence of power elements on the circulation of airflow, there is a large flow stagnation region at the cover plate or top cover, which weakens the working of partial region of the fan blade 131. The improved fan 130 of the present disclosure can avoid the formation of the above airflow stagnation region, thereby improving the capacity of the air conditioner outdoor unit 100 and increasing the working efficiency of the fan 130.

In the air conditioner outdoor unit 100 of the present disclosure, by adjusting the installation angle of the fan blade 131 of the fan 130, the radial flow phenomenon on the surface of the fan blade 131 can also be reduced and aerodynamic noise can be decreased while improving the working capacity of the fan blade 131.

In some embodiments of the present disclosure, when the air conditioner outdoor unit 100 adopts a top air supply structure, most of the power elements are arranged on a bottom wall of the cabinet; for example, the heat exchanger 123 is arranged at the position of the air inlet 111, and the compressor 121 assembly is arranged on the bottom wall, and is connected to the heat exchanger 123 through a pipeline. At this time, the fan 130 can be arranged between the air outlet 112 and the refrigerant circulation device 120. Under the action of the fan 130, the airflow enters the cabinet 110 through the air inlet 111, and flows toward the fan 130 and the air outlet 112 under the interference of the compressor 121 assembly. By adjusting the installation angle of the fan blade 131 of the fan 130, the influence of the compressor 121 assembly on the working of the fan 130 can be greatly eliminated.

In order to eliminate the interference of the refrigerant circulation device 120 on the airflow path 113, in the air conditioner outdoor unit 100 in this embodiment, the region where the elementary stage installation angle needs to be adjusted is appropriately increased. In the plane perpendicular to the rotational axis of the fan 130, a first circular region 133 is set with the rotational axis as the center, and the area of the first circular region 133 is at least larger than or equal to the projection region 132 in the above embodiment. The projection region 132 is the projection of the partial region of the power elements that interferes with the airflow path 113 on the fan 130 in the direction of the rotational axis of the fan 130, and there is at least one inscribed point 134 between the first circular region 133 and the projection region 132. In this embodiment, the installation angle α of the fan blade 131 at any elementary stage within the first circular region 133 is set to be larger than the installation angle α of the fan blade 131 at the elementary stage outside the first circular region 133. By appropriately increasing the adjustment region of the installation angle of the fan blade 131, the influence of power elements on the fan 130 is further reduced.

It should be noted that in the air conditioner outdoor unit 100 in this embodiment, the power elements that form the projection region 132 can be the compressor 121 and a tank connected to the compressor 121, or the electric control box and heat dissipation element among the power elements.

In an embodiment of the air conditioner outdoor unit 100 of the present disclosure, the compressor 121 and a liquid storage tank 122 connected to the compressor 121 among the power elements are provided on the bottom wall of the cabinet 110 and arranged opposite to the fan 130. In the direction of the rotational axis of the fan 130, the compressor 121 and the liquid storage tank 122 connected to the compressor 121 are projected to form the projection region 132 described above. By adjusting the installation angle of the fan blade 131 within the projection region 132, the influence of the compressor 121 and the liquid storage tank 122 on the circulation of airflow is reduced.

The fan 130 of the air conditioner outdoor unit 100 can be configured as an axial flow fan 130. The axial flow fan 130 is provided with at least one fan blade 131, and can also be provided with three fan blades 131, which are evenly distributed in the rotational direction A of the axial flow fan 130. The axial flow fan 130 further includes a hub, and the three fan blades 131 are connected to the hub. The installation angle of each fan blade 131 within the projection region 132 or the first circular region 133 is adjusted so that the installation angle at any elementary stage within it is larger than the installation angle outside the projection region 132 or the first circular region 133. After each fan blade 131 of the fan 130 is adjusted, the overall working capacity of the fan 130 is improved, which not only improves the working efficiency, but also can reduce the formation of aerodynamic noise.

The area of the first circular region 133 is larger than or equal to the area of the projection region 132, and there is at least one inscribed point 134 between an outer edge of the first circular region 133 and an outer edge of the projection region 132. The installation angle $\alpha$ of the fan blade 131 at any elementary stage within the first circular region 133 is larger than the installation angle $\alpha$ of the fan blade 131 at the elementary stage outside the first circular region 133.

In order to reduce the noise that may be generated during the working process of the fan 130, a vortex disturbing structure 1312 is provided on the fan blade 131 of the fan 130 of the air conditioner outdoor unit 100 according to the embodiment of the present disclosure. In the rotational direction A of the fan 130, the fan blade is formed with a vortex disturbing structure 1312 in the region of the rear edge 1311 of the fan blade. The vortex disturbing structure 1312 is arranged in the region of the rear edge 1311 of the fan blade to prevent the airflow from detaching from the fan blade 131 to generate noise.

The vortex disturbing structure 1312 can be formed in an uneven region of the rear edge 1311 of the fan blade. When the airflow moves on the fan blade 131, the vortex disturbing structure 1312 can prevent the airflow from forming vortices on the fan blade 131, thereby reducing the possibility of generating noise by the airflow during the flow process.

A flow guide member 140 can also be provided on the outer side of the fan 130. The flow guide member 140 has a flow guide channel 144 which is sleeved on the outer side of the fan 130, and a preset gap is provided between an inner wall surface of part of the flow guide channel 144 and the outer edge of the fan blade 131 of the fan 130 to prevent airflow from generating noise between the outer edge of the fan 130 and the inner wall of the flow guide channel 144. The preset gap can be set to any value between 5 mm and 15 mm.

For example, the flow guide channel 144 can be provided with an inlet section 141, a middle section 143, and an outlet section. The middle section 143 is arranged between the inlet section 141 and the outlet section 142, and the vortex disturbing structure 1312 can be provided at each of the inlet section, the outlet section 142 and the middle section 143 respectively to reduce the formation of noise.

In some embodiments of the present application, the middle section 143 of at least part of the flow guide channel 144 is configured into a straight cylinder shape, and the fan blades 131 of the fan 130 are arranged in the straight cylinder-shaped flow guide channel 144. The vortex disturbing structures 1312 on the fan blades 131 of the fan 130 can also be arranged in the straight cylinder-shaped flow guide channel 144 to reduce the possibility of noise generation.

Providing the uneven region on the rear edge 1311 of the fan blade can disperse the energy of the vortices formed on the fan blade 131, and disperse the vortices to prevent larger vortices from generating noise. Providing the preset gap between the flow guide member 140 and the outer edge of the fan blade 131 of the fan 130 can prevent vortex detachment on the fan blade 131, prevent the formation of pulsating air pressure after vortex detachment, and thus prevent the generation of noise.

For the uneven region on the rear edge 1311 of the fan blade, a structural form of concave portions and convex portions can be provided. Multiple concave portions and multiple convex portions are arranged on the rear edge 1311 of the fan blade to disperse the energy of the vortices. Multiple concave portions and multiple convex portions can also be alternately arranged in a serrated shape.

In some embodiments of the present application, a first vortex disturbing structure is provided at the outlet section 142 of the flow guide member 140, and the first vortex disturbing structure is connected to the middle section 143. Most of the serrated vortex disturbing structure 1312 is accommodated in the middle section 143. By providing the first vortex disturbing structure at the outlet section 142 of the flow guide member 140, when the fan 130 rotates, the regular interference frequency of the driven airflow with surrounding objects is increased, and the frequency of the low-frequency noise accumulated by the rotation of the fan 130 is increased. The spikes of the rotating noise in the same frequency band are reduced, thereby reducing the low-frequency noise during use and effectively improving the user experience.

The first vortex disturbing structure can be a protruding part provided on the inner wall surface of the outlet section 142, or a cut-out part, or a combination of a protruding part and a cut-out part. The cut-out part provided on the inner wall surface of the outlet section 142 has a flat surface smoothly connected to the inner wall surface. The connection between the flat surface and the inner wall surface can be linear, or arc shaped, or curve shaped. When the airflow flows from the inner wall surface of the outlet section 142 to the cut-out part, since the distance in the direction perpendicular to the rotational axis of the fan 130 changes, that is, the radial distance changes, the interference on the airflow is increased, and the spikes of the rotating noise in the same frequency band are reduced, thereby reducing the airflow noise. When multiple cut-out parts are provided on the inner wall surface of the outlet section 142, or uniformly arranged in the axial direction of the flow guide member 140, the airflow can be subject to periodic interference on the inner wall surface of the outlet section 142, and the noise spikes in the airflow are reduced more significantly.

The protruding part arranged on the inner wall surface of the outlet section 142 has an arc-shaped wall surface and is smoothly connected to the inner wall surface of the outlet section 142. Due to the protruding part arranged on the inner wall of the outlet section 142, when the airflow flows from the inner wall surface of the outlet section 142 to the arc-shaped wall surface of the protruding part, the distance in the direction perpendicular to the axial direction of the flow guide member 140 changes, that is, the radial distance changes, causing interference on the circulation of airflow and reducing the spikes of the rotating noise in the same frequency band, thereby reducing the airflow noise.

In some embodiments of the present application, a second vortex disturbing structure 1312 can be provided in the inlet section of the flow guide member 140, and the second vortex disturbing structure 1312 is connected to the middle section 143 of the flow guide member 140. The second vortex disturbing structure 1312 can be a cut-out part, or a protruding part, or a combination of a cut-out part and a protruding part. Similar to the technical effect of the first vortex disturbing structure in the outlet section, the airflow is subject to regular interference. When multiple cut-out parts or protruding parts are provided, the frequency of interference on the airflow is increased, the frequency of the low-frequency noise accumulated by the rotation of the fan 130 is increased, and the spikes of the rotating noise in the same frequency band are reduced, thereby reducing the low-frequency noise during use.

In the above different embodiments, the implementation of providing the vortex disturbing structure 1312 on the fan blades 131 of the fan 130 and the implementation of providing the flow guide member 140 with a flow guide channel 144 on the outer side of the fan 130 are given, each with the purpose of preventing the fan blades 131 of the fan 130 from generating noise during rotation.

The air conditioner outdoor unit 100 provided by the present disclosure not only provides an implementation of improving the working capacity of the fan 130, but also provides an implementation of avoiding the generation of noise while improving the working efficiency of the fan 130.

In the air conditioner outdoor unit 100, the power elements of the compressor 121 and the tank group are overall located at the flow incoming position of the air duct system. There is a large flow stagnation region at the top cover located at the outlet of the fan 130, which weakens the work done by the fan blade 131 that interferes with its projection plane. At the same time, due to the influence of incoming flow disturbance, the work done by different elementary stage sections on the surface of the fan blade 131 is uneven, and the radial flow phenomenon is intensified, affecting the working capacity and efficiency of the fan blade 131 and increasing aerodynamic noise. The present disclosure optimizes the design of the fan system in the air conditioner outdoor unit 100, and optimizes the design of the blade profile of the fan blade 131; especially in the region affected by the interference of the compressor 121 and the tank group in the air duct system, the working capacity is improved to suppress the influence of the incoming flow disturbance of the fan blade 131, improve the working capacity of the fan blade 131, reduce the radial flow phenomenon on the surface of the fan blade 131, improve its efficiency, and reduce its aerodynamic noise.

In some embodiments of the present disclosure, the air conditioner outdoor unit 100 further includes a heat exchanger 123, which is arranged inside the cabinet 110 and located below the fan 130. The heat exchanger 123 encloses a heat exchange air duct, which is communicated with the air outlet 112 of the cabinet 110. Under the action of the fan 130, the air in the heat exchange air duct is discharged through the air outlet 112 of the cabinet 110, and the outer side of the heat exchanger 123 is arranged opposite to the air inlet 111 on the cabinet 110, so that an airflow path 113 is formed between the air inlet 111 and the air outlet 112 of the cabinet 110. The airflow at least passes through the heat exchanger 123, the heat exchange air duct, the fan 130, and the flow guide member 140 arranged on the outer side of the fan 130, and is discharged through the air outlet 112 of the cabinet 110.

The heat exchanger 123 inside the cabinet 110 of the air conditioner outdoor unit 100 can also be arranged on the side of the fan 130 that is away from the air outlet 112.

In some embodiments of the present disclosure, the heat exchanger 123 is arranged to extend along the wall surface of the cabinet 110, and the refrigerant circulation device 120 is accommodated in an space enclosed by the heat exchanger 123, which includes the compressor 121 and the liquid storage tank 122 connected to the compressor 121, and which may also include the electric control box and a heat dissipation element connected to the electric control box. In this embodiment, the heat exchanger 123 includes a G-type heat exchanger 123 arranged below the fan 130, and this arrangement is suitable for air conditioner outdoor units 100 with a top air supply structure, in which the air outlet 112 is arranged at the top of the cabinet 110.

In some embodiments of the present disclosure, the flow guide member 140 is provided with a noise reduction structure 145, which is formed in the outlet section 142 or the inlet section 141. The noise reduction structure 145 can be the first vortex disturbing structure or second vortex disturbing structure 1312 as described in the above embodiments. By providing the noise reduction structure 145, the air conditioner outdoor unit 100 can achieve the effect of quietness, without generating new airflow noise while improving the circulation capacity of airflow.

In some embodiments of the present disclosure, the air outlet 112 of the air conditioner outdoor unit 100 is arranged at the upper end of the cabinet 110, the air inlet 111 is arranged on the side wall of the cabinet 110, and the air inlet 111 is at least partially arranged opposite to the heat exchanger 123.

The present disclosure also provides an air conditioner, which includes the air conditioner outdoor unit 100 as described in any one of the above items.

Described above are only preferred specific embodiments of the present disclosure, but the scope of protection of the present disclosure is not limited to this. Any changes or replacements that can be easily conceived by those skilled in the art within the technical scope disclosed by the present disclosure should be covered within the scope of protection of the present disclosure. Therefore, the scope of protection of the present disclosure should be accorded with the scope of protection of the claims.

The invention claimed is:

1. An air conditioner outdoor unit comprising:

a cabinet comprising an air inlet and an air outlet, an airflow path being formed between the air inlet and the air outlet;

a refrigerant circulation device, arranged inside the cabinet and comprising a component part located in the airflow path; and a fan, provided inside the cabinet and arranged opposite to the air outlet;

wherein:

in a direction of a rotational axis of the fan, the component part has a projection region on the fan;

the fan comprises at least one fan blade; and an installation angle of the at least one fan blade at an elementary stage within the projection region is a first installation angle, an installation angle of the at least one fan blade at an elementary stage outside the projection region is a second installation angle, and the first installation angle is larger than the second installation angle.

2. The air conditioner outdoor unit according to claim 1, wherein:

a first circular region with a point on the rotational axis as the center is provided in a plane perpendicular to the rotational axis;

the area of the first circular region is larger than or equal to the projection region, the projection region is located within the first circular region, and there is at least one intersection point between an outer edge of the first circular region and an outer edge of the projection region; and an installation angle of the at least one fan blade at the elementary stage within the first circular region is a third installation angle, an installation angle of the at least one fan blade at the elementary stage outside the first circular region is a fourth installation angle, and the third installation angle is larger than the fourth installation angle.

3. The air conditioner outdoor unit according to claim 2, wherein:

the refrigerant circulation device comprises a compressor and a liquid storage tank connected to the compressor; and the compressor and the liquid storage tank are located on one side of the fan in the direction of the rotational axis.

4. The air conditioner outdoor unit according to claim 1, wherein:

the at least one fan blade has a rear edge of the fan blade and an outer edge of the fan blade;

the outer edge of the fan blade is a side of the fan blade that is away from the rotational axis of the fan, and the rear edge of the fan blade is connected to the outer edge of the fan blade; and the orientation of the rear edge of the fan blade is opposite to the rotational direction of the fan, and a vortex disturbing structure is provided on the rear edge of the fan blade.

5. The air conditioner outdoor unit according to claim 4, wherein:

the air conditioner outdoor unit further comprises a flow guide member, sleeved on an outer side of the fan;

the flow guide member comprises an inlet section, an outlet section, and a middle section; and the middle section is connected between the inlet section and the outlet section, and at least a part of the vortex disturbing structure is provided in the middle section.

6. The air conditioner outdoor unit according to claim 5, wherein the flow guide member comprises a noise reduction structure formed in at least one of the outlet section or the inlet section.

7. The air conditioner outdoor unit according to claim 1, wherein the refrigerant circulation device further comprises a heat exchanger arranged inside the cabinet and located on a side of the fan that is away from the air outlet.

8. The air conditioner outdoor unit according to claim 7, wherein the heat exchanger is arranged to extend in a circumferential direction of a side wall of the cabinet and enclose a heat exchange channel.

9. The air conditioner outdoor unit according to claim 8, wherein:

the air outlet is arranged at an upper end of the cabinet;

the air inlet is arranged on the side wall of the cabinet; and both the air inlet and the air outlet are communicated with the heat exchange channel.

10. An air conditioner comprising the air conditioner outdoor unit according to claim 1.

* * * * *